US005450625A

United States Patent [19]

Hu

[11] Patent Number: 5,450,625

[45] Date of Patent: Sep. 19, 1995

[54] ELBOW AND KNEE GUARDS WITH REMOVABLE SHELL PROTECTORS

[76] Inventor: Antonio C.-H. Hu, 4240 Suzanne Dr., Palo Alto, Calif. 94306

[21] Appl. No.: 193,567

[22] Filed: Feb. 8, 1994

[51] Int. Cl.[6] ..... A41D 13/00

[52] U.S. Cl. ..... 2/16; 2/22

[58] Field of Search ..... 2/24, 911, 908, 267, 2/268, 22, 44, 45, 16, 62, 2

[56] References Cited

U.S. PATENT DOCUMENTS

| | | | |
|---|---|---|---|
| 3,761,960 | 10/1973 | Woodcock | 2/22 |
| 3,945,046 | 3/1976 | Stromgren | 2/22 |
| 3,945,047 | 3/1976 | Jarrell | 2/24 |
| 4,272,850 | 6/1981 | Rule | 2/24 |
| 4,370,754 | 2/1983 | Donzis | 2/413 |
| 4,554,681 | 11/1985 | Kirkland | 2/2 |
| 4,599,747 | 7/1986 | Robinson | 2/24 |
| 4,642,814 | 2/1987 | Godfrey | 2/2 |
| 4,796,303 | 1/1989 | Atwater | 2/24 |
| 4,926,503 | 5/1990 | Wingo | 2/267 |
| 4,991,230 | 2/1991 | Vacanti | 2/2 |
| 5,024,216 | 6/1991 | Shiono | 2/24 |
| 5,168,576 | 12/1992 | Krent | 2/2 |
| 5,226,192 | 7/1993 | Jones et al. | 2/267 |

FOREIGN PATENT DOCUMENTS

| | | | |
|---|---|---|---|
| 600584A1 | 6/1994 | European Pat. Off. | 2/24 |
| 2421638 | 12/1979 | France | 2/24 |

*Primary Examiner*—Clifford D. Crowder
*Assistant Examiner*—Paul C. Lewis
*Attorney, Agent, or Firm*—Robert Samuel Smith

[57] ABSTRACT

A guard for a knee, elbow or shin including a composite pad of layers of perforated fabric, foam and mesh, all bound together at the periphery by a band of heavy fabric and strapped to the limb with an adjustable elastic band. The knee and elbow guards have one composite pad strapped above the joint and another composite pad strapped below the joint. A rigid shell is strapped to the composite pad. The straps have VELCRO patches which permit adjustment of the shell or complete separation from the pads.

29 Claims, 3 Drawing Sheets

ELBOW AND KNEE GUARDS WITH REMOVABLE SHELL PROTECTORS

BACKGROUND

1. Field of the Invention

This invention relates generally to guards for the knees and elbows such as are used in contact sports and particularly to a knee guard with a removable shell.

2. Prior Art and Information Disclosure

Injuries to the knees and elbows occur all too frequently in sports such as mountain biking, snow boarding, skate boarding and especially in roller skating and in-line skating. Participants in team sports such as hockey, football, and baseball are also prone to injuries to the joints and limbs. Current growth of in-line skating has heightened interest in ways to reduce injury when participating in these activities. Therefore a number of protective devices have been disclosed which are intended to prevent injury from blows to these areas.

U.S. Pat. No. 3,945,046 to Stroingmn discloses a flexible knee support including a tubular sheath extending around the back of the leg but not covering the knee with broad elastic bands around the leg, one above and one below the knee. The device is intended to support the knee joint rather than protect the knee cap area.

U.S. Pat. No. 3,945,047 is a knee protector including a rubberlike sleeve in which the back of the knee is exposed to provide some degree of flexibility. A compartment over the knee cap is fillable with a fluid for cushioning. Side compartments receive hinged panels for support of the knee joint. The device is suitable for orthopedic uses but is too bulky and restrictive for active athletic use.

U.S. Pat. No. 4,796,303 to Atwater is for a knee protector pad including an elastic sleeve to maintain the pad in its intended position. The pad accomodates various sizes of legs by virtue of the elastic sleeve. Therefore, such a pad would be too tight for a large leg and too loose for a small leg.

U.S. Pat. No. 4,272,850 to Rule is for a thick foam sleeve that fits around the knee and has transverse slits extending part way through the sleeve to the outside surface to provide more freedom for flexing the knee joint. The sleeve entirely covers the knee joint so that the joint would be overheated during active use.

Other disclosures are directed toward composite structures that are intended to confer certain characteristics on pads used in various situations related to protection of the body. U.S. Pat. No. 5,168,576 to Krent et al is for protective body padding comprising a plurality of foam modules interconnected by a membrane having a plurality of perforations extending therethrough and a matrix of interconnecting air channels. Hardness to resist impact is conferred by having an outer layer of the foam being a higher density than the interior part of the foam This construction would not provide the wear resistance to abrasion or tensile strength to resist tearing that is an object of the guard of the present invention.

U.S. Pat. No. 4,991,230 to Vacanti discloses shock absorbing body pads including inflated compartments that communicate with the ambient environment through a plurality of ducts. The impervious construction of the pads mitigate against evaporation of moisture from the skin adjacent to the pads.

U.S. Pat. No. 4,642,814 to Godfrey discloses non metallic springs encapsulated in a vinyl type material.

This complex construction does not permit "breathing" of the skin such as desired for elimination of heat.

U.S. Pat. No. 4,926,503 to Wingo discloses a pad comprising two layers of foam having two different densities. This construction does not provide the tensile strength required to bind various sections of a knee guard together which is an object of the present invention.

None of the foregoing disclosures combine the degree of tensile strength, resistance to wear and tear, breathability, nor accomodation to a variety of situations such as use for either recreational skating or stunt skating which is an object of the present invention.

THE INVENTION

OBJECTS

It is an object of this invention to provide a guard for protection of a number of body parts including the knees and elbows.

It is another object that the guard be secured by means having a snugness around the arm or leg that is independent of the size of the arm or leg.

It is another object that the guard has a shell that has sufficient rigidity to cover especially vulnerable areas such as the kneecap or the point of the elbow and that the location and fit of this component against the protected area be adjustable.

It is another object that the shell be detachable from the means for attaching the guard to the limb such as when it is desired to substitute a shell of different size, color, or hardness or when it is desired to wash the guard.

It is another object that the snugness and fit of the shell against the protected area be adjustable such that an additional pad can be positioned between the inner side of the shell and the guard when additional protection is desired.

It is another object that the means for attaching an edge of the shell above the joint and the means for attaching an edge of the shell below the joint provide additional protection to the convex side of the joint using a construction that provides ventilation to the covered area and without sacrificing strength of the attachment of the guard to the limb.

It is another object to direct the force of a blow away from the apex of a joint such as a knee or elbow.

It is another object that the guard be modular in nature such that the guard can be used with or without an additional pad layer between the shell and guard and such that the guard can be used with or without the shell.

SUMMARY

This invention is directed toward a guard for an area of the body comprising a shell detachably attached by straps to a composite pad There are patches of hook and eye material (e.g., "VELCRO") attached to the straps such as to permit adjusting tightness of the shell against the pad. The composite pad includes a perforated sheet next to the skin, a layer of shock absorbing material such as foam and a mesh over the shock absorbing material next to the shell all held together by a border of fabric. The foam has a pattern of openings which together with the perforated material and mesh enables circulation of moisture laden air next to the user's skin. The border of fabric is an anchor both for holding the pad (foam, mesh and perforated material) together and for attachment of the rigid shell.

In one embodiment, the protected area is a joint. The rigid shell is held adjustably detachably secured to the composite pad over the apex of the joint (knee or elbow). One section of the composite pad is secured by a strap around the limb above the joint and another section of the composite pad secured by a strap around the limb below the joint. A cloth hinge joins the two sections of composite pad. Each strap around the limb is an elastic band with "hook and eye" patches (such as "VELCRO") thereby providing accomodation to various sizes of the limb.

In another embodiment, the knee guard of this invention has an additional composite pad joined to the bottom edge of the knee guard and extends over the shin. A shell coveting the composite pad is detachably attached to the composite shin pad by straps as described above.

In yet another embodiment, the guard of this invention has an additional composite pad joined to the bottom edge of the elbow guard and extends over the forearm. A shell covering the pad over the forearm is detachably attached to the composite elbow pad.

In the context of this specification, the "convex" side of the limb is to be understood as meaning the side of the limb including the apex of the joint such as the kneecap or point of the elbow. The concave side of the limb is opposite the convex side.

FIGURES

DESCRIPTION OF A PREFERRED EMBODIMENT

Figure 1:
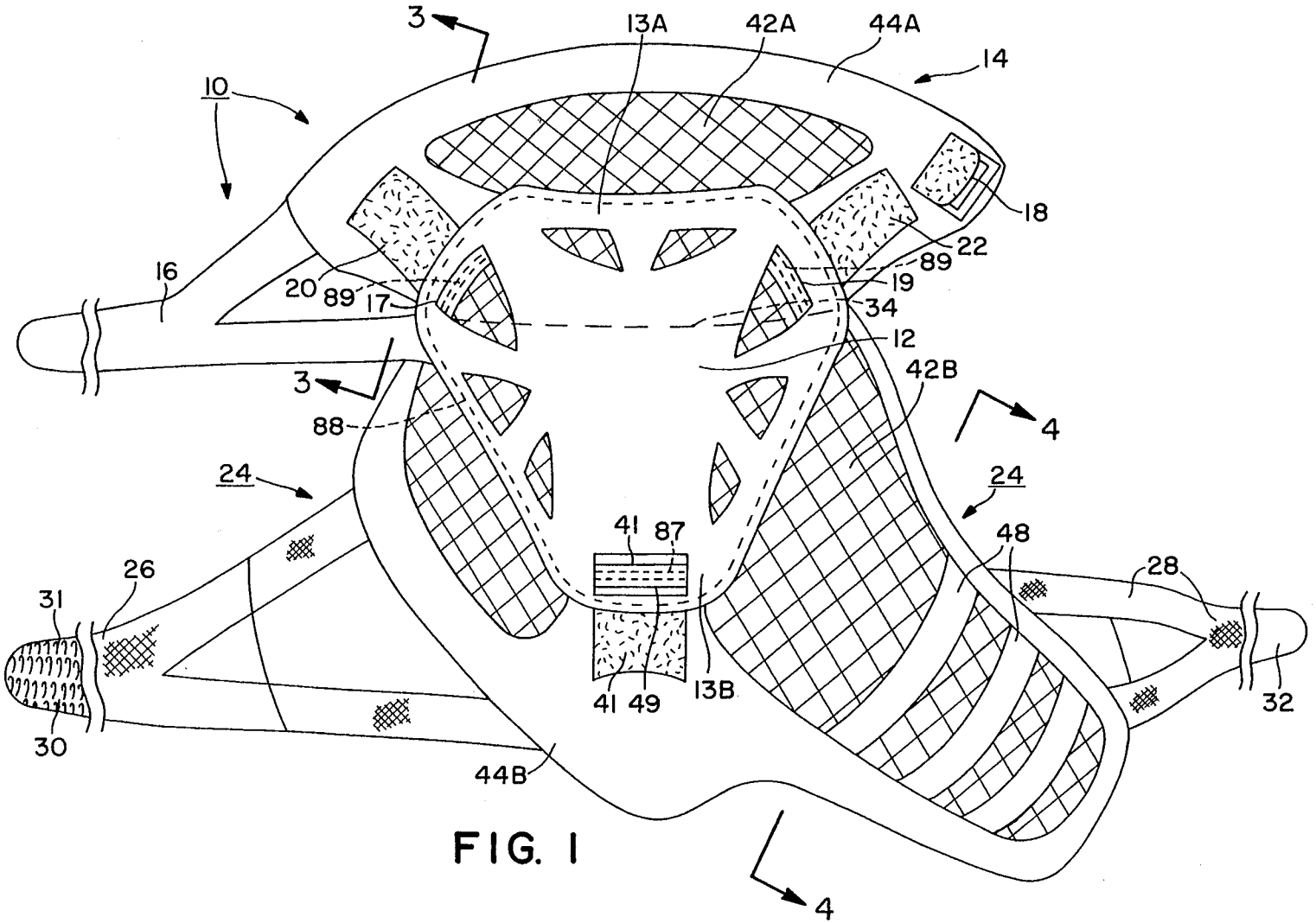
FIG. 1 is a front view of the knee guard spread out to show its entirety.

Turning now to a discussion of the drawings, FIG. 1 is a front view of a knee guard 10 constructed according to the invention in which the knee guard 10 has been stretched out to show three major components of the knee guard. One component is a rigid shell 12 that is positioned against a composite pad. A cushion strip 88 shown in phantom in FIG. 1 extends around the perimeter of the shell 12.

The second component is top section 14 of the composite pad that is secured around the leg above the knee (leg not shown in FIG. 1 ) by strap 16 which circles around the leg and engages buckle 18. Strap 16 has hook and eye patches 51 and 53 shown in FIG. 2 but not shown in FIG. 1 because they are on the underside of strap 16 in FIG. 1.

The third component is a bottom section 24 of the composite pad having straps 26 and 28 Strap 26 extends around the leg below the knee and has an end 30 with a patch 31 of "hook" material that engages a patch 33 of "eye" material on the underside of the end 32 of strap 28. In the exploded view of FIG. 2, patches 31 and 33 are shown displaced from but adjacent to their respective ends 30 and 32.

The top edge section 13 A of shell 12 is secured to top section 14 of the composite pad by straps 20 and 22 and the bottom edge section 13B of shell 12 is secured to bottom section 24 of the composite pad by straps 41 as discussed below in the discussion of FIG. 2.

The top section 14 of the composite pad is joined to the bottom section 24 of the composite pad by a cloth hinge 34 shown in phantom in FIG. 1 along line 34. The cloth hinge 34 is a narrow strip of cloth (single) layer sewn along one edge to a joining edge of the bottom section 24 and along an opposite edge to an adjoining edge of top section 14. This construction provides maximum freedom for flexing the knee while providing that both top section 14 and bottom section 24 have sufficient bulk. and strength for securely binding both sections of the composite pad to the leg independent of one another.

Figure 2:
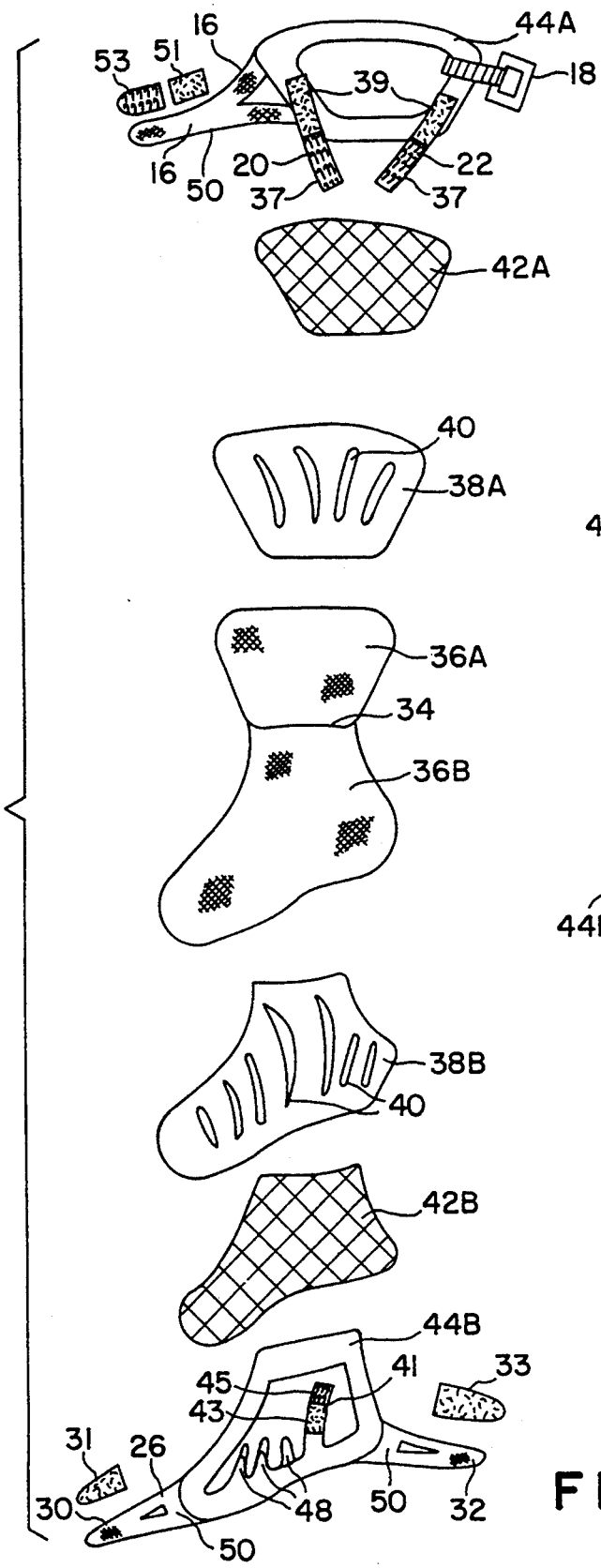
FIG. 2 is an exploded view of the composite pads.
Figure 3:
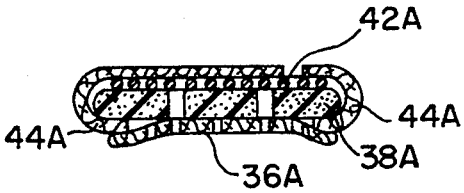
FIG. 3 shows a cross section of the top composite pad.
Figure 4:
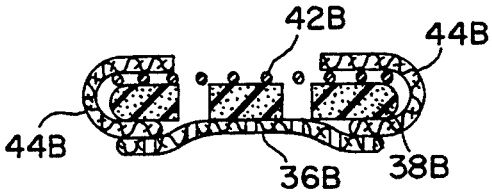
FIG. 4 shows a cross section of the bottom composite pad.

FIG. 2 shows the shell removed and the layers (44A, 42A, 38A 36A) of the top section 14 and the layers (44B, 42B, 38B, 36B) of the bottom section 24 separated from one another and laid in a column. FIG. 3 is a sectional view of the top section and FIG. 4 is a sectional view of the bottom section 24 showing the arrangement of the layers. The layers include a layer 36A and 36B of perforated sheet (preferably light weight moisture-wicking fabric such as COOLMAX manufactured by Dupont, Inc.) that is next to the skin. The perforations allow moist air to escape from the skin. The next layer (38A and 38B) is a thick cushion layer of shock absorbing material such as robber, foam or honeycomb plastic that has channel openings 40 and is positioned with one side against the perforated material 36A and B. The cushion layer 38 A and B is selected to absorb the force of sharp blows on the shell 12 and additionally cover and protect areas around the front of the leg and above and below the knee where the blows are not as severe on the kneecap but where maintaining freedom of motion is an important consideration. The outer surface of the cushion layer 38A and 38B is covered with a heavy open mesh (42A and 42B), preferably nylon, which is selected for its ability to enclose the foam pad 38 A and B so as to prevent the foam pad from "bunching up" and also to protect the cushion layer from abrasion.

A border, 44A for the top section 12 and 44B for the bottom section 24, of heavy weight fabric is stitched around the entire periphery of the assembled layers (36, 38, 42) of the pad. As shown in FIG. 2, band 44A and 44B has a convoluted shape (when laid out flat) in order that one edge be laid over top of the composite pad where it is fastened to mesh 44 A and B and the band is wrapped around the edge of cushion 38 so that the opposite edge of band 44 is inserted between perforated sheet 36 and the other side of cushion 38 permitting that cushion 38, perforated sheet 36, and one edge of band 44 can all be stitched together and mesh 42 and the other edge of band 44 can be stitched together so that band 44 becomes the common binding element that holds the whole pad together. Methods other than stitching such as flame laminating or gluing can be used to attach the fabric 44 to the composite pad assembly.

The border 44A is also stitched to one end of straps 20 and 22, each of which loop around a bar 89 shown in phantom in FIG. 1 across openings 17 and 19 of the shell 12. Straps 20 and 22 have a length of hook material 37 and eye material 39 so that the ends of each strap 20, 22, can be folded back on itself to secure the top end of the shell 12 to the top section 14 of the knee guard 10 as shown in FIG. 1.

Similarly, the border 44B of the bottom section 24 is stitched to an end of strap 41. Strap 41 has a patch of hook material 43 and eye material 45 so that the bottom edge of the shell 12 is secured to the bottom section 24 by looping strap 41 around a bar 87 shown in phantom in FIG. 1 across opening 49 of shell 12 and folding the strap 41 back on itself. This construction for attaching the shell 12 to the top section 14 and bottom section 24 of the composite pad is a means for adjusting the fit of the shell 12 against the knee cap. This is an important feature of the invention since it allows the user to either wear the shell fight against the knee cap or to loosen the strap such as when it may be desirable to place an additional cushion between the shell and knee such as when the knee is recovering from an injury. This construction also allows the user to exchange his shell for a shell that has a heavier or lighter liner, exchange a fabric shell for a plastic shell, change the shell color, or remove the shell for washing.

With the snaps 22, 24, 41 looped around bars 89 and 87 respectively, the hook patches and the eye patches on the straps are pressed together between the shell and composite pads. Therefore, the only way the shell can be separated from the pad is by shear force between the eye patch and the hook patch. A hook and eye patch has much greater strength in shear than in peel so that an important feature of this invention is the great tenacity with which the shell is secured against the pad.

Additionally, fingers 48 extend across the coarse mesh 42B and are bonded (such as by stitching or flame laminating ) to the mesh and cushion layer. The fingers 48 strengthen the composite pad (mesh, cushion layer, perforated fabric) against tears and additionally maintains the shape of the composite pad by preventing "bunching up" of the cushion layer. The heavy fabric border 44B therefore serves as a base for firmly securing all the pans of composite pad together (mesh, cushion and fabric and the shell).

FIG. 2 shows details of the straps 16 which secure the top section 14 of the composite pad around the leg. Strap 16 has an elastic base 50. A patch 51 of hook material and a patch 53 of eye material (shown separated from elastic base 50 in FIG. 2) are secured to elastic band 50 so that the elastic strap 16 has an adjustable length by virtue of the loop through buckle 18 and the hook-eye (VELCRO) attachment.

Each elastic section biases the strap such as to permit elongation and contraction of the length of the strap in accordance with the motion of the leg. The VELCRO sections of each strap permit the wearer to adjust the average length of the strap and thereby accomodate the guard to various sizes of the limb.

The composite pads of the top and bottom sections have three characteristics which are based upon the unique construction of the pad.

Each composite pad provides a cushion that is effective in protecting the knee from force of blows during use of the knee guard. This feature is provided by an inner cushion. The cushion is foam (such as a cross-linked low-density polyethylene, EVA or polyurethane) and has substantial thickness to deaden blows such as from falling or from, e.g., a hockey stick, and has large channel openings so as to permit circulation of air and evaporation of perspiration from one side of the pad to the other.

Each composite pad "breathes" to avoid overheating the knee area of the leg. This feature is provided by the fabric 36A and B with a spaced array of apertures which protect the foam from constant rubbing by the skin that would otherwise wear away the foam. The aperture array permits the escape of the moisture laden air from the skin and provides a contact of the knee guard with the skin that is comfortable to the user.

The rigid shell is preferably polyethylene, ABS, polycarbonate, nylon or polyurethane. The construction described above permits detachment of the shell from the rest of the knee guard. This feature is useful for such purposes as:

- changing the color of the shell, e.g., in accordance with team colors;
- putting on larger or smaller shells depending on the activity;
- inserting cushions in back of the shell such as may be desired when recovering from an injury to the knee cap area or providing additional protection;
- attaching a shell having a hardness selected according to the circumstances; for example an activity requiring a large range of motion such as sprinting requires a more resilient shell. than a shell for skaters where the range of motion for the joint is not as great. Various choices for the material of the shell can include fabric or plastic.

Figure 5:
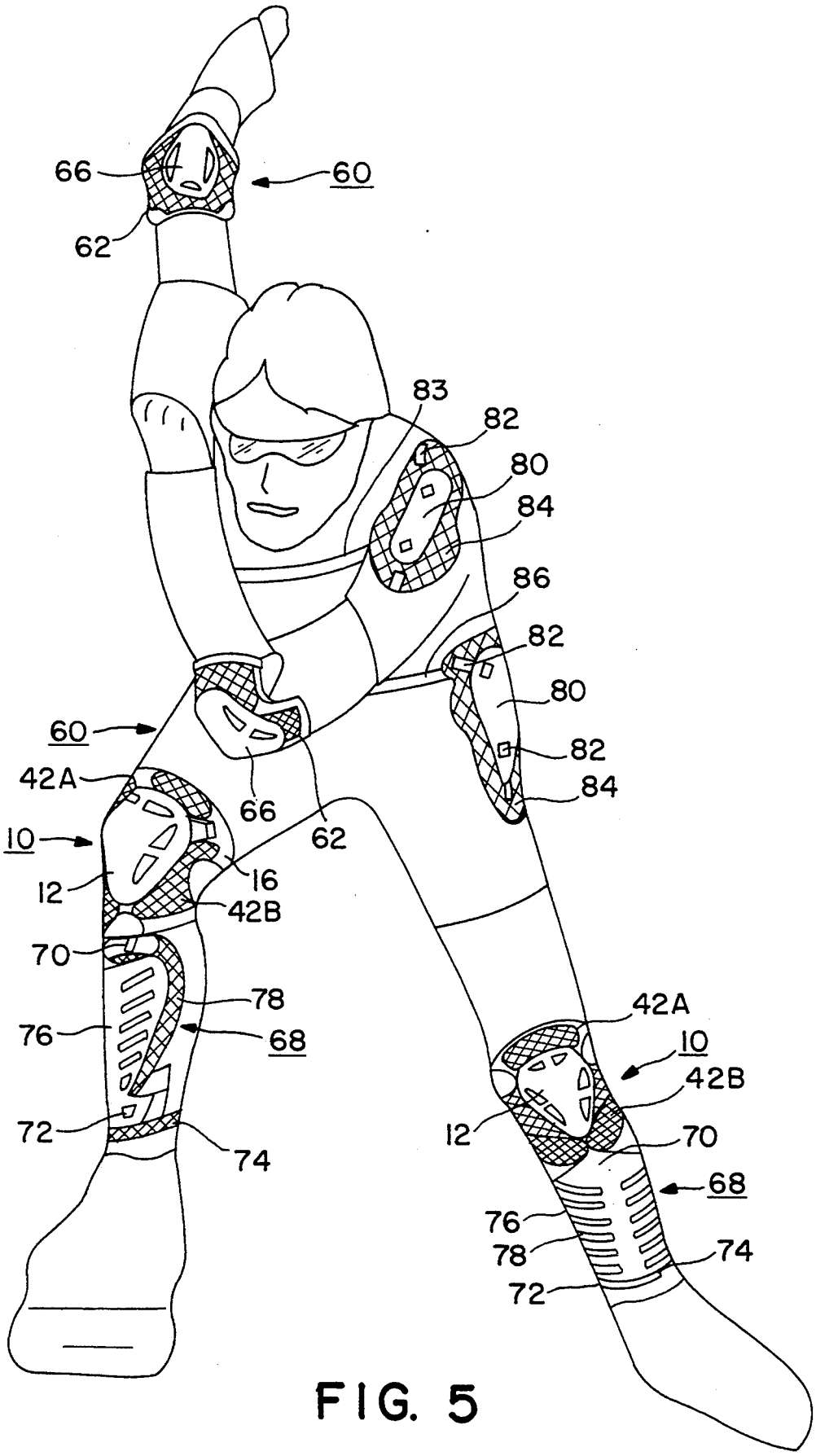
FIG. 5 shows a skater wearing the guards of the invention.

The same construction of the knee guard shown in FIG. 1 can also be used to construct a guard for the elbow. FIG. 5 shows a skater wearing a pair of knee guards 10 and a pair of elbow guards 60 A guard 60 for the elbow includes a composite pad 62 strapped to the forearm with a shell 66 attached to each pad and covering the point of the elbow. The composite pad 62 includes the mesh, foam and perforated fabric construction described above and are joined together with the cloth hinge.

FIG. 5 also shows a shinguard 68 below the bottom of the knee guard 10 for protecting the shins. Each shin pad includes a rigid shell 76 overlaying a composite pad 78. The top edge 70 of the shin guard 68 may be attached to the bottom edge of the knee guard 10 by a cloth hinge or be secured by a strap (not shown) around the upper calf of the user. The bottom edge 72 of the shin guard 68 is strapped to the leg close to the ankle by a strap 74. Strap 74 is constructed with the elastic band and the hook and eye material (elastic and hook eye material not shown in FIG. 5) similar to straps 26 and 28 described in FIG. 1, wherein one part is an elastic band and another part is the hook material that attaches to the eye material of the other half of the strap. The rigid shell 76 is removably secured to the composite shin pad 78 by velcro straps as described above for the knee guard. The shin pad has the perforated fabric, foam, mesh layered construction secured by a perimeter of heavy reinforcing fabric as described in FIG. 2.

FIG. 5 further shows a guard of this invention for the shoulder and hip. There is shown a shell 80 held against a composite pad 84 by straps 82. The hip guard is held against the hip by belt 86. The guard is held against the shoulder by strap 83 around the chest.

In accordance with objects of the invention, features of the embodiment include attachment of a removable rigid shell to a top section above the joint (knee or elbow) and to a bottom section below the joint. The top and bottom sections each include a composite pad secured to the limb (leg or arm) by a strap around the concave side of the joint so that padded protection is provided to the kneecap area or point of the elbow while maximum ventilation and freedom of motion is provided on the opposite side of the joint. The structure of the straps having an elastic in combination with hook and eye material provides accomodation to a range of sizes of the user's leg or arm. The attachment of the shell against the joint being adjustable by virtue of attachment with the VELCRO straps, permits replacement of the shells and adjustment of the shell against the joint.

In view of variations and modifications suggested by study of the specification and drawings, I wish to define the scope of my invention to the appended claims.

I claim:

1. A guard for an area of the body comprising:

a composite pad having a first surface opposite a second surface and wherein said composite pad has a sheet having an array of perforations adapted for laying one side of said sheet against skin of a user, a layer of shock absorbing material with open channels and positioned with a side of said layer against another side of said sheet, a mesh having a side positioned against another side of said layer a fabric band fastened around a perimeter of each said composite pad such as to bind said mesh, layer and sheet together, first means for attaching said composite pad to said area with said first surface of said pad against said area;

a shell having a shell surface shaped to fit against said second surface of said composite pad;

said shell having an edge section with at least one opening proximal to said edge section;

at least one strap having one end attached, to said composite pad and another end looped through one of said at least one opening;

second means for detachably attaching said one end looped through said opening to a section of said strap intermediate said ends of said strap.

2. A guard as in claim 1 which comprises at least one bar, each one of said at least one bar mounted across one of said at least one opening respectively.

3. A guard as in claim 1 wherein said second means comprises: a patch of hook material and a patch of eye material, both patches secured on a surface of each one of said at least one strap one of said patch of hook material and patch of eye material extending from said intermediate section to an end of said other one of said patch of hook material and said eye material and said another one of said patch of hook material and said patch of eye material extending from an end of said other patch to a free end of said strap in operable arrangement such that said patch of hook material on an end of each one of said straps looped around said bar, respectively, is laid back against and adheres to said patch of eye material on said each one of said at least one of said straps.

4. A guard as in claim 1 wherein said layer is selected from a a group of materials that consists of foam, rubber and honeycomb plastic.

5. A guard as in claim 1 wherein said shell has a strip of shock absorbing material around a perimeter of said shell facing said mesh.

6. A guard as in claim 1 wherein said guard has a shape adapted to conform to a shin.

7. A guard as in claim 1 wherein said guard has a shape adapted to conform to a knee.

8. A guard as in claim 1 wherein said guard has a shape adapted to conform to an elbow.

9. A guard as in claim 1 wherein said guard has a shape adapted to conform to a forearm.

10. A guard as in claim 1 wherein said guard has a shape adapted to conform to a hip.

11. A guard as in claim 1 wherein said guard has a shape adapted to conform to a shoulder.

12. A guard for a joint of a limb, aid joint having an apex, said limb having a convex side including said apex and opposite a concave side, said guard comprising:

a first composite pad;

a second composite pad each said first and second composite pads having a sheet having an array of perforations adapted for laying one side of said sheet against skin of a user, a shock absorbing layer with open channels and positioned with side of said shock absorbing layer against another side of said sheet, a mesh having a side positioned against another side of said layer, a fabric band stitched around a perimeter of each said first and second composite pad such as to bind said mesh, layer and sheet together respectively;

first means for detachably attaching said first composite pad to said convex side of said limb on one side of said joint;

second means for detachably attaching said second composite pad to said convex side of said limb on another side of said joint;

a shell adapted for fitting over said apex and having a first edge section adjacent said first composite pad and opposite a second edge section adjacent to said second composite pad;

said shell having at least one opening proximal to said first edge section and at least one opening proximal to said second edge section;

at least one first strap having one end attached to said first composite pad and another end looped through one of said at least one opening proximal to said first composite pad;

third means for detachably attaching said another end of each one of said at least one first strap to a section of said each one of said at least one first strap between ends of said each one of said at least one first strap, at least one second strap having one end attached to said second composite pad and another end looped through one of said at least one opening proximal to said second composite pad;

fourth means for detachably attaching said another end of each one of said at least one second strap to a section of said each one of said at least one second strap between end of said each one of said at least one second strap.

13. A guard as in claim 12 which comprises:

a plurality of bars;

each one of said openings proximal to said first and second edge sections having one of said plurality of bars extending across said respective opening.

14. A guard as in claim 12 wherein said third means for detachably attaching said another end comprises:

a patch of hook material and a patch of eye material, both patches secured on a surface of each one of said at least one first strap;

said patch of hook material arranged in operable combination with said eye material such that each one of said another end adheres to a section of a respective one of said at least one first strap; and wherein said fourth means for detachably attaching said another end comprises:

a patch of hook material and a patch of eye material, both patches secured on a surface of each one of said at least one second strap;

said patch of hook material arranged in operable combination with said eye material such that each one of said another end adheres to a section of a respective one of said at least one second strap.

15. A guard as in claim 12 wherein said first composite pad has a first side edge opposite a second side edge and said first means for detachably securing said first composite pad to said limb comprises:

a third strap having one end secured to said first side edge;

a patch of eye material and a patch of hook material, both patches adhered to a surface of said third strap;

a buckle attached to a second side edge of said first composite pad;

said buckle and third strap arranged in operable combination with one another such that said third strap looped through said buckle and folded back with said hook material engaging said eye material provides that a length of said first means for attaching is adjustable to accomodate various sizes of said limbs while maintaining a desired tightness of said third strap around said limb.

16. A guard as in claim 12 wherein said first composite pad has a first side edge opposite a second side edge and said first means for detachably securing said first composite pad to said limb comprises:

an elastic third strap having one end secured to said first side edge;

a patch of eye material adhered to a surface of said third strap;

an elastic fourth strap having one end secured to said second side edge;

a patch of hook material adhered to a surface of said fourth strap operably arranged in combination with said eye material to adhere to said eye material with said third and fourth straps adapted to be wrapped around said limb.

17. A guard as in claim 12 wherein said shock absorbing layer is selected from a group consisting of rubber, foam and honeycomb plastic.

18. A guard as in claim 12 comprising a cloth hinge joining an edge of said first composite pad to an edge of said second composite pad.

19. A guard as in claim 12 wherein said limb is an arm, said joint is an elbow, said apex is a point of said elbow.

20. A guard as in claim 12 wherein said limb is a leg, said joint is a knee, said apex is a kneecap.

21. A guard as in claim 12 wherein said first composite pad has a third edge between said first and second side edges distal from said second composite pad and said guard comprises:

a third composite pad having a fourth edge hingeably joined to said third edge of said first composite pad; a strap secured to an edge of said third composite pad distal from said first composite pad and adapted for being secured around said limb.

22. A guard as in claim 21 wherein said limb is an arm, said joint is an elbow, said apex is a point of said elbow and said third composite pad is arranged to cover a forearm adjacent to said elbow.

23. A guard as in claim 21 wherein said joint is a knee and said third composite pad is adapted for coveting a shin of said leg.

24. A guard for a joint of a limb, said joint having an apex, said limb having a convex side including said apex and opposite a concave side, said guard comprising:

a first composite pad having a sheet with an array of perforations adapted for laying one side of said sheet against skin of a user, a shock absorbing layer with open channels and positioned with a side of said shock absorbing layer against another side of said sheet, a mesh having a side positioned against another side of said shock absorbing layer, a fabric band secured around a perimeter of said first composite pad such as to bind said mesh, shock absorbing layer and sheet together;

a first elastic strap having one end attached to a first side edge of said first composite pad, a patch of eye material and a patch of hook material, both patches adhered to a surface of said first elastic strap;

a buckle attached to a second side edge of said first composite pad opposite said first side edge;

said buckle and first strap arranged in operable combination with one another such that said first elastic strap looped through said buckle and folded back with said patch of hook material detachably engaged with said patch of eye material provides that a length of said first elastic strap is adjustable while maintaining a desired tightness of said first elastic strap around said leg;

a second composite pad having a sheet with an array of perforations adapted for laying one side of said sheet against skin of a user, a shock absorbing layer with open channels and positioned with a side of said shock absorbing layer against another side of said sheet, a mesh having a side positioned against another side of said shock absorbing layer, a fabric band secured around a perimeter of said second composite pad such as to bind said mesh, shock absorbing layer and sheet together;

a second strap having one end attached to a first side edge of said second composite pad;

a third strap having one end attached to a second side edge of said second composite pad;

a patch of hook material attached to a surface of said second elastic strap;

a patch of eye material attached to a surface of said third elastic strap;

said patches of hook material and eye material arranged in operable combination such that said patch of hook material is detachably attached to said patch of eye material a shell adapted for fitting over said apex and having a first edge section opposite a second edge section and having a plurality of openings proximal to said first edge section with a bar extending across each said opening;

at least one fourth strap, each having one end attached proximally to an edge of said first composite pad and another end looped through one of said plurality of openings around said bar across said one of said plurality of openings;

a plurality of patches of hook material and patches of eye material, one of each said plurality of patches of hook material and one of said patches of eye material secured on a surface of one of said at least one fourth strap respectively in operable arrangement such that said patch of hook material on an end of one of said fourth straps looped around said bar is laid back against and adheres to said patch of eye material on said each one of said at least one of said straps respectively;

at least one fifth strap having one end attached proximally to an edge of said second composite pad and another end looped through one of said at least one opening around said bar;

a patch of hook material and a patch of eye material, both patches secured on a surface of each one of said at least one fifth strap in operable arrangement such that said patch of hook material on an end of each one of said fifth straps looped around said bar, respectively, is laid back against and adheres to said patch of eye material respectivel, a cloth hinge joining an edge of said first composite pad to an edge of said second composite hinge.

25. A guard as in claim 24 wherein said shock absorbing layer is selected from a group consisting of foam, rubber and honeycomb.

26. A guard for an area of a limb which comprises:

a composite pad having a sheet with an array of perforations adapted for laying one side of said sheet against skin of a user, a shock absorbing layer with open channels and positioned with a side of said shock absorbing layer against another side of said sheet, a mesh having a side positioned against another side of said shock absorbing layer, a fabric band secured around a perimeter of said composite pad such as to bind said mesh, foam and sheet together;

at least one first strap having one end attached to a first side edge of said composite pad;

at least one second strap having one end attached to a second side edge of said composite pad;

a patch of hook material attached to a surface of said at least one first elastic strap;

a patch of eye material attached to a surface of said at least one second elastic strap;

said patches of hook material and eye material arranged in operable combination such that each said patch of hook material is detachably attached to one of said patches of eye material respectively;

a shell adapted for fitting over said composite pad and having at least one opening proximal to an edge of said composite pad with a bar extending across each said at least one opening;

at least one third strap having one end attached proximally to an edge of said first composite pad and another end looped through one of said at least one opening around said bar;

at least one patch of hook material and at least one patch of eye material, one of said at least one patch of hook and eye material secured on a surface of each one of said at least one third strap respectively in operable arrangement such that said patch of hook material on an end of said third strap is looped around one of said bars and is laid back against and adheres to said patch of eye material respectively.

27. A guard as in claim 26 wherein said shock absorbing layer is selected from a group of materials that consists of honeycomb, rubber and foam.

28. A guard as in claim 26 wherein said at least one first strap and said at least one second strap are elastic.

29. A guard as in claim 27 wherein said first strap and said second strap and said third strap are elastic.

* * * * *